United States Patent [19]

Beckershoff

[11] 4,386,885

[45] Jun. 7, 1983

[54] COOLED GUIDE SUPPORT VANE

[75] Inventor: Wolfgang Beckershoff, Nussbaumen, Switzerland

[73] Assignee: BBC Brown Boveri & Company Limited, Zurich, Switzerland

[21] Appl. No.: 260,336

[22] Filed: May 4, 1981

[30] Foreign Application Priority Data

May 19, 1980 [EP] European Pat Off. ..... 80200461.4

[51] Int. Cl.[3] ..... F01D 5/18; F02C 7/16

[52] U.S. Cl. ..... 415/178; 415/116

[58] Field of Search ..... 415/115, 116, 175, 178, 415/177, 134; 416/96 R

[56] References Cited

U.S. PATENT DOCUMENTS

| | | | |
|---|---|---|---|
| 2,489,683 | 11/1949 | Stalker | 415/116 |
| 3,275,294 | 9/1966 | Allen et al. | 415/115 |
| 3,300,178 | 1/1967 | Rizk et al. | 415/115 |
| 3,544,232 | 1/1970 | Zerlauth | 415/134 X |
| 3,734,639 | 5/1973 | Short | 416/96 R X |
| 3,736,069 | 5/1973 | Beam, Jr. et al. | 415/115 |
| 4,184,689 | 1/1980 | Brodell et al. | 415/134 X |

FOREIGN PATENT DOCUMENTS 58095 10/1940 Denmark .

1111332 1/1953 Fed. Rep. of Germany .

*Primary Examiner*—Philip R. Coe
*Assistant Examiner*—Frankie L. Stinson
*Attorney, Agent, or Firm*—Werner W. Kleeman

[57] ABSTRACT

In order to improve cooling of an at least two-part guide vane support or carrier for gas turbines, at which deformations do not occur during any operating state and whose parting surface-connection flanges and connection elements are constructed such that they can withstand, essentially free of deformation, all bending moments resulting from the thermal stresses, it is proposed to design the cooling agent channels arranged within the wall of the guide vane support alternately over the circumference thereof as infeed lines or openings and/or outfeed lines or openings and containing connection channels leading to the individual guide vanes or blades. The guide vane support possesses an essentially conical configuration over its axial extent. At the guide vane support there are provided substantially comb-like slotted elements defining the parting surface-connection flanges and the individual comb-like slotted elements may comprise individual sheet metal members which are fixed, as by welding, to the guide vane support.

11 Claims, 10 Drawing Figures

COOLED GUIDE SUPPORT VANE

BACKGROUND OF THE INVENTION

The present invention relates to a new and improved construction of a guide vane support or carrier for a gas turbine, the guide vane support being constructed as a two-part or bipartite structure and is equipped with cooling channels. The guide vane or blade support carries cooled guide vanes or blades and concentrically to the lengthwise axis of the turbine possesses a substantially conical construction.

In machines which are operated by a working medium at high pressure and high temperature, for instance gas turbines, the problems which arise most frequently occur at those components or parts which are directly subjected to the action of the hot process or working gases. These problems are essentially attributable to the reduced strength of the materials from which these components are formed, when exposed to the high operating temperatures, and to the increased corrosion proneness of such components or parts. Moreover, high static and non-static thermal stresses arise at such components, so that the sealing of unavoidable expansion gaps becomes difficult which, depending upon the operating state of the equipment can vary, i.e. between start-up and shutdown of the gas turbine, and render problematic a leakage-free infeed and withdrawal of the cooling agent or medium.

The guide vane supports or carriers of gas turbines take-up the aerodynamic forces which act upon the guide vanes or blades and transmit such to the housing or casing, wherein, however, the guide vane supports, at relatively higher inherent temperature, are not subjected to the typical boiler stresses like the machine housing. Furthermore, such type guide vane supports are constructed as separate components or parts, thus affording the possibility that they can freely expand by virtue of their inherent temperature. These guide vane supports are arranged in conventional manner within the machine housing such that they advantageously are fixed and sealed at the flow downstream located cooler components or parts.

The continuous increase in the output and efficiency of gas turbines is obtained by increasing the operating temperatures and operating pressures. Consequently, cooling becomes increasingly more problematic because owing to the high compressor-final or exit pressure and the high compressor exit temperature of the compressed air the air temperature is much too high for use for cooling the endangered components or parts and no longer can be effectively employed as a cooling agent or medium.

SUMMARY OF THE INVENTION

Therefore, with the foregoing in mind it is a primary object of the present invention to provide a new and improved construction of cooled guide vane or blade support which is not associated with the aforementioned drawbacks and limitations heretofore discussed.

Another and more specific object of the present invention aims at providing a new and improved construction of a cooled guide vane support or carrier wherein deformations do not arise during any operating state of the equipment and whose parting surface-connection flanges and threaded connection elements are constructed such that they can withstand, essentially free of deformation, all bending moments resulting from the thermal stresses.

Still a further important object of the present invention contemplates providing a completely pressure-tight, leakage-free cooling agent connection both to and from the individual components or parts which are to be cooled.

Now in order to implement these and still further objects of the invention, which will become more readily apparent as the description proceeds, the cooled guide vane support or carrier of the present development is manifested by the features that the cooling agent channels arranged in the wall of the guide vane support are constructed over the circumference thereof alternately as infeed lines and/or outfeed lines for the cooling agent and provided with connection channels leading to the individual guide vanes or blades. Furthermore, the guide vane support is of substantially conical configuration over its axial extent. In the context of this disclosure and the appended claims this is to be specifically understood as meaning that the guide vane support may nonetheless contain a substantially cylindrical portion, typically located at the high-pressure side of such guide vane support, i.e., at least the major or predominant lengthwise extent of the guide vane support possesses an essentially conical configuration.

The conical design of the guide vane support renders possible arranging cooling agent channels in its walls. The essentially curvature-free and bend-free construction of its lengthwise sectional profile reduces to a minimum the bending moment at the parting surface flanges or connection flanges owing to residual thermal stresses in the wall.

The cooling agent-tap bores branching-off from the cooling agent or medium channels and leading to the individual guide vanes or blades render possible a substantially uniform and adjustable flow of the cooling medium or agent. Due to the inventive arrangement of preferably inclined axially extending bores or channels at the wall-centroidal axis there are beneficially avoided elongation differences which could otherwise lead to bending moments and flange loads resulting therefrom.

The construction of the cooling agent guides in the form of inclined axially extending flow channels or as pipes or tubes which are moulded into the wall of the guide vane support, which alternately possess over the circumference of the guide vane support cooling agent infeed lines and outfeed lines, render possible a mean compensation of the locally different temperature effect by virtue of such arrangement which alternates about the circumference of the guide vane support. Also with this design there can be provided at suitable locations radial or radial-axial feed bores leading from or to the components or parts which are to be cooled.

The arrangement of the cooling agent-flow channels in the neutral zone or region of the guide vane support wall affords the advantage that, on the one hand, there can be prevented the unavoidable weakening of the guide vane support wall upon the occurrence of bending moments and traction forces and, on the other hand, there can be avoided irregular temperature distributions owing to different residual wall thicknesses and the deformations resulting therefrom.

The arrangement of a substantially cylindrically constructed portion at the high-pressure side end of the guide vane support or carrier simplifies the attachment of the components following such end, for instance the entry or infeed segments, the hot gas housing and the intermediate jacket or shell.

Since the guide vane supports possess a parting or separation surface which is preferably located in the horizontal plane, there must be provided a parting surface connection which is structured such that there is effectively prevented any spreading apart of the portions forming the guide vane support during the operation of the equipment because of the arising bending moments resulting from thermal stresses.

The construction of the connection flanges of the guide vane support according to the invention in the form of substantially comb-like slotted elements, for instance slotted flanges, wherein the comb-like slotted elements are formed for example by welding individual sheet metal members, enables threadably interconnecting the parting surface-connection flanges by means of threaded bolts or equivalent fastening structure which lie within the slots of the comb-like slotted elements and which slots are open to one side. The flange material bounding the slots receiving the threaded bolts form rib-like projections which in conjunction with the wall of the guide vane support form a comb-like profile or section shape. Since each slot need only possess in each case a width essentially corresponding to the width of the bolt shaft, for instance the width or diameter of an elongation shaft of an elongation or expansion bolt, it is possible to maintain the comb pitch appreciably smaller. Additionally, the open slots enable the air emanating from the compressor and flowing about the guide vane support to freely circulate about these components, so that both the flange material and also the attachment or fastening bolts are uniformly heated. Consequently, there is advantageously avoided the otherwise usual thermal stresses at the flange zone and the over expansion of the bolt shaft beyond the yield strength or point. Since there can be intensified the moment of resistance and the total cross-section at the region of the slots by virtue of the comb-like profile, the slots can be designed to be so deep that they touch the provided sealing ledge or the like. The groove base of the slots is constructed to possess a substantially semi-circular configuration, so that there is extensively eliminated any notch effect. This particularly is beneficial in the case of comb-like profiles which are welded together from sheet metal parts and manifests itself advantageously in an extensively smoother wall transition in comparison to the notch effect, and there is also facilitated the elimination of the burning pentration which arises during welding.

The elongation bolts are retained in nut supports or underlays or equivalent structure which in each case bridge a slot. These nut supports together with their preferably round boundary surface are located in a groove which is disposed essentially parallel to the flange surface and possessing a substantially semi-circular shaped cross-sectional configuration.

Advantageously, with a dimensioning of the same strength the outer contour of the comb-like constructed flange sheet metal members extends practically linearly and the comb portion related to a smooth wall produces a thickness distribution which, in relation to the heretofore known flange contours, results in appreciably less material collections. This is true both for the cross-section itself and also for the prevailing moments of resistance. Also with such construction there are absent the abrupt cross-section transitions.

According to the inventive construction of the guide vane support there are locked thereat the entry or infeed portions or segments in axial direction, and specifically in a manner such that massive or robust projections of the infeed portions or segments latch behind elastically resilient nose members provided at the guide vane support. During the axial displaceable mounting or insertion of the infeed segments the connection elements leading to the cooling agent channels are simultaneously brought into an elastic, form-locking or frictional connection with the guide vane support. Due to this design there is possible both an axial assembly and disassembly of the first row of guide vanes or blades of the gas turbine without having to uncover the machine.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have generally been used the same reference characters to denote the same or analagous components and wherein.

DETAILED DESCRIPTION OF THE PREFERRED EMBODIMENTS

Figure 1:
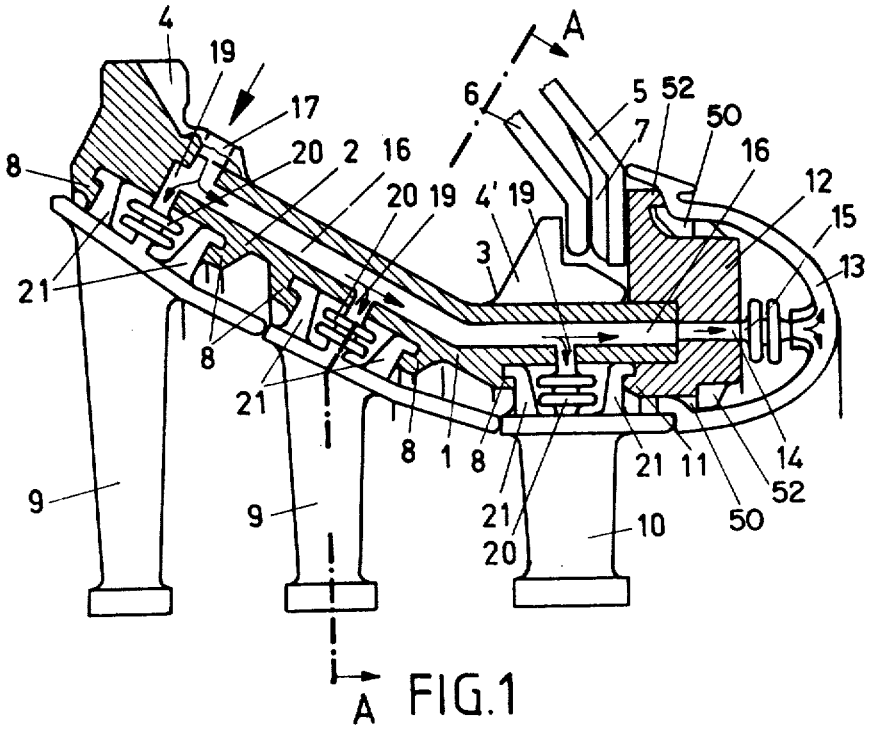
FIG. 1 is a longitudinal sectional view through a guide vane support or carrier equipped with a cooling agent-infeed arrangement leading to the guide vanes or blades and to the entry portions or segments.

Describing now the drawings it is to be understood that only enough of the construction of the machine, typically a gas turbine, with which the inventive guide vane or blade support may be advantageously used, has been shown to enable those skilled in the art to readily understand the underlying principles and concepts of the present development. Turning attention now specifically to FIGS. 1 and 2 reference character 1 generally designates a guide vane support or carrier which embodies a substantially conical constructed portion 2 and a substantially cylindrical portion 3. The conical portion 2 essentially possesses the same angle of inclination over its entire length. At both vane support or carrier portions 2 and 3 of the guide vane support 1 there are arranged guide noses 4 and 4' which guide the guide vane support 1 in the here not particularly illustrated machine housing. The guide noses 4' additionally serve the purpose of limiting displacement of a hot gas housing 5 having an intermediate shell or jacket 6, and a rib member 7 serves as a spacer element of holder between both of these components or parts 5 and 6. At the guide vane support or carrier 1 there are suspended at suspension means 8 of the conical portion 2 guide vanes or blades 9, whereas a first high-pressure side guide vane row 10 is arranged at the substantially cylindrical portion 3 and at a nose or nose member 11 of a locking element 12. At the locking element 12 there are also attached hollow constructed infeed or entry segments 13 having the elastically resilient nose members 50. Furthermore, the locking element 12 serves for guiding and sealing the connection of the hot gas housing 5 as well as for guiding the intermediate shell or jacket 6 and a cooling agent throughpass or passage 14 for introduction of the entry or infeed segment-cooling agent. This locking element 12 also serves for the support of the infeed segment 13 and to that end the nose members 50 engage with projections 52 of the locking element 12, the retention of the first guide vane row 10, as well as for guiding of cooling agent-connection elements 15 which are arranged between the cooling agent throughpass or passage 14 and the cooling channel system of the infeed segment 13.

Arranged in the guide vane support 1 are cooling channels 16 which are supplied with the cooling agent or medium, typically air, by means of the inlet opening 17 and from which there outflows the heated-up cooling agent by means of the outlet or discharge openings 18 defining connection channels. The inlet openings or lines 17 and the outlet openings or lines 18 are alternately arranged adjacent one another over the circumference of the guide vane support 1 as also will be particularly well seen by referring to FIGS. 4 and 5. The cooling channels 16 are connected by means of the connection channels 19 with the cooling channel system of the guide vanes or blades 9 and 10. Between the connection channels 19 and inlet openings in the guide vanes 9 and 10 there are arranged sealing elements 20 provided with throughpassages or passageways, these sealing elements preventing escape of cooling agent into the space between the guide vane feet 21. The cooling channels 16 can be closed at the high-pressure end of the guide vane support or carrier 1 if it is not necessary to cool any of the infeed or entry segments 13. Since the cooling channels 16 alternately supply over the circumference of the guide vane support 1 the guide vanes 9 and 10 alone and additionally also the infeed segments 13 with cooling agent, therefore at one time alternately in pairs the cooling channel 16 is closed or the same is free in the direction of the cooling agent throughpass or passage 14, respectively. The arrows shown in FIGS. 1 and 2 designate the flow direction of the cooling agent or medium.

Figure 2:
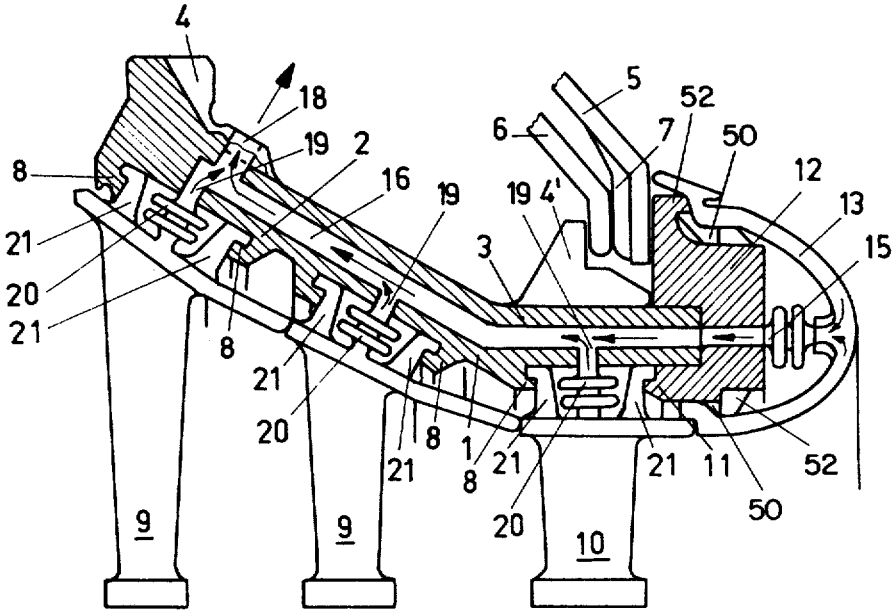
FIG. 2 is a longitudinal sectional view through a guide vane support containing a cooling agent-outfeed arrangement from the guide vanes and the entry or infeed segments.
Figure 3:
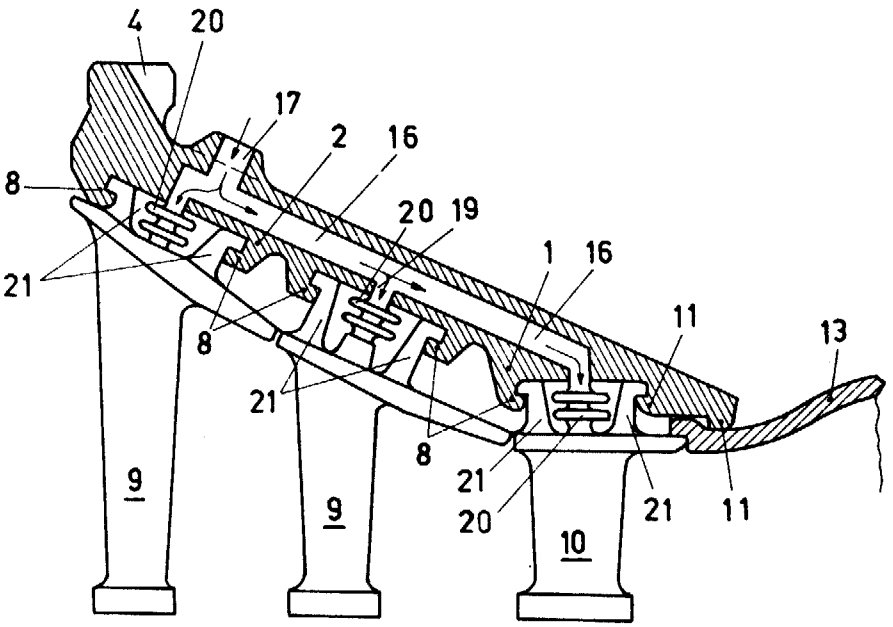
FIG. 3 is a longitudinal sectional view through a conically constructed guide vane support or carrier without a cylindrical portion.

In FIG. 3 there has been illustrated an embodiment of a guide vane support 1 without the cylindrical portion 3, as shown for the embodiment of FIGS. 1 and 2, wherein again here also the same parts have been conveniently designated for this variant construction with the same reference characters as used in the arrangement of FIGS. 1 and 2. With this exemplary construction the infeed or entry segment 13 can be constituted, for instance, by a closure piece or element of an annular combustion chamber.

Figure 4:
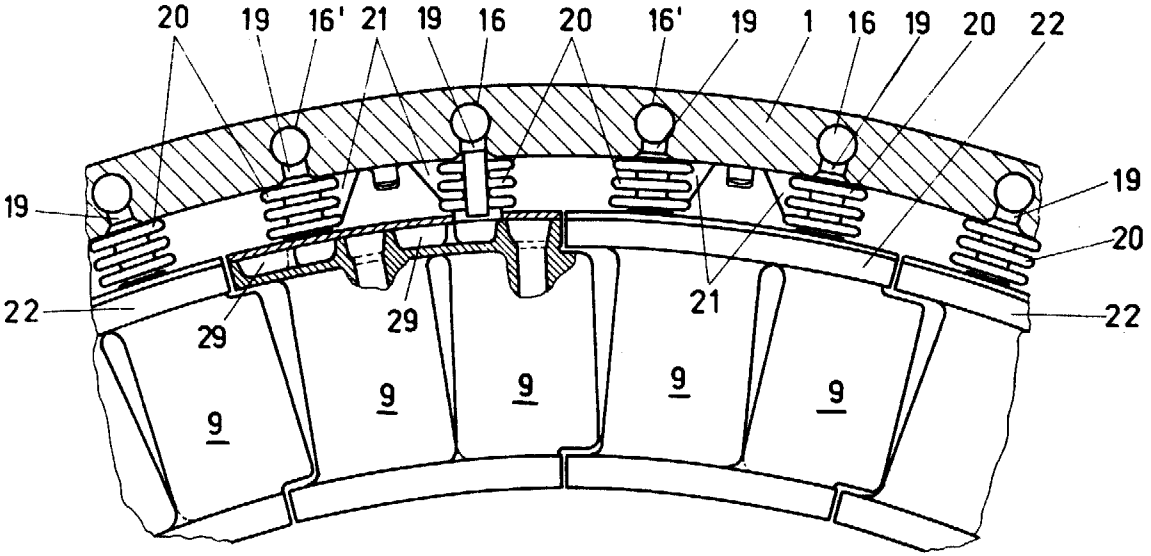
FIG. 4 is a cross-sectional view through the guide vane support or carrier shown in FIG. 1, taken substantially along the section line A—A thereof.
Figure 5:
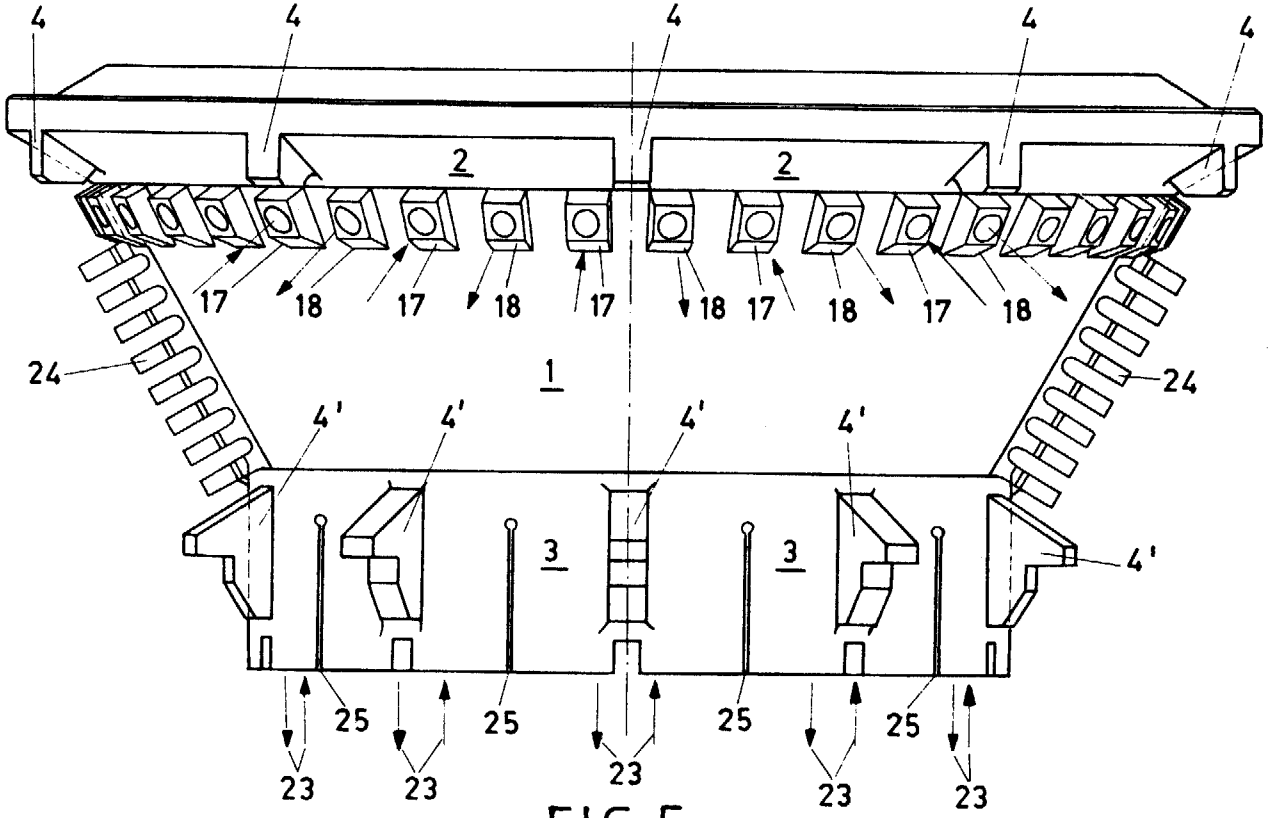
FIG. 5 is a top plan view of the guide vane support containing inlet and outlet openings for the cooling agent or medium.

The cross-sectional view shown in FIG. 4 and taken through the guide vane support or carrier 1 of FIG. 1 renders clear the alternating arrangement of the infeed lines 17 and the outfeed lines 18 of the cooling channels 16, 16'. In each case preferably two guide vanes or blades 9 are attached to a common base or foot plate 22, and there are arranged in each foot plate 22 distributor channels 29 in a manner such that they flow communicate with the connection channels 19.

In the arrangement of FIG. 5 there have been again conveniently used the same reference characters for the same parts or components as in the various embodiments of FIGS. 1 to 4. From the illustrated top plan view of the guide vane support 1 there will be clearly seen the arrangement of the inlet or infeed openings or lines 17 and the outlet or outfeed openings or lines 18 leading into and out of the guide vane support 1 and which lead to the cooling channels 16. Between the inlet openings 17 and the outlet openings 18 there are arranged the guide noses or nose members 4. At the lower portion of the showing of FIG. 5 there has been illustrated the cylindrical portion 3 possessing the nose members 4' and by the arrows 23 there have been represented the cooling medium transfer locations to and from the here not particularly shown entry or infeed segments 13.

At the parting surface region of the guide vane support 1 there are provided comb-like connections, here shown as comb-like slotted elements 24, for instance in the form of open slotted connection flanges *26a, 26b*. The cylindrical portion 3 of the guide vane support 1 possesses slots 25 which essentially eliminate the reinforcement action of the bends located between the conical portion 2 and the cylindrical portion 3 as well as the related bending moments at the flanges or connection flanges *26a, 26b* in the presence of temperature differences.

Figure 6:
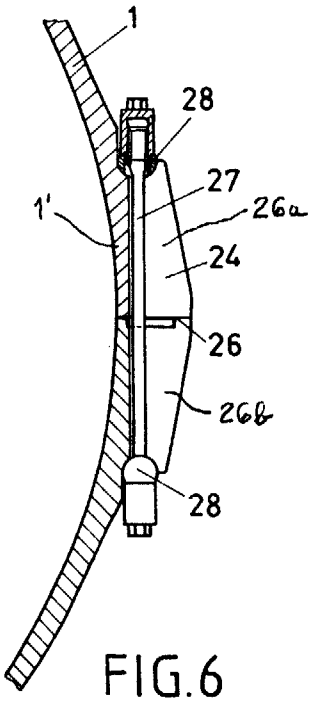
FIG. 6 is a cross-sectional view through a parting surface-connection flange arrangement.
Figure 9:
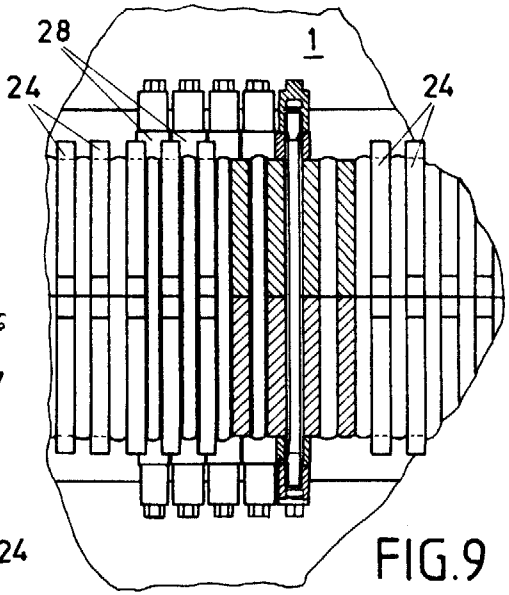
FIG. 9 is a side view of a comb-like parting surface-connection arrangement.
Figure 10:
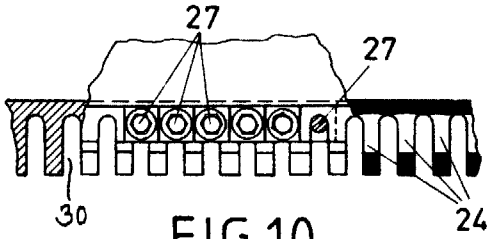
FIG. 10 is a top plan view of the arrangement of FIG. 9.
Figure 7:
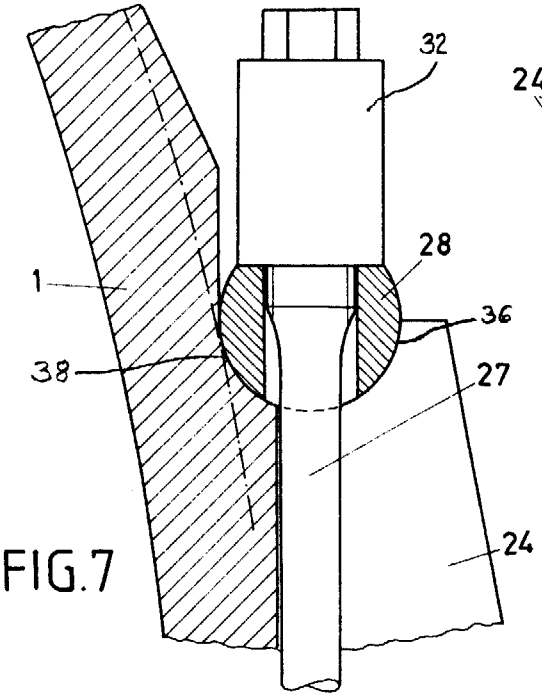
FIG. 7 illustrates an enlarged detail of a threaded bolt arrangement located in the parting surface-connection flange arrangement according to FIG. 6.
Figure 8:
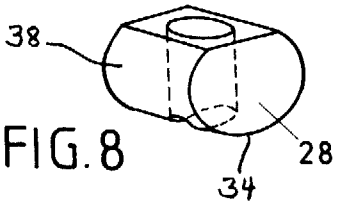
FIG. 8 is a perspective view of a possible construction of nut support or underlay for the threaded connection bolt of the connection flange arrangement according to FIG. 6.

The illustrations of FIGS. 6, 7 and 8 show in detail the parting plane or parting surface connections constituted by the flanges *26a, 26b*, wherein reference character 1' designates the wall of the guide vane support or carrier 1 at which there is arranged at each wall half a related flange or connection flange *26a, 26b*, as best seen from the showing of FIG. 6. The coacting flanges *26a, 26b* are pulled together by appropriate fixation or fastening elements, here shown as attachment bolts 27, preferably elongation bolts. The connection flanges or flanges *26a, 26b* are constructed such that the wall 1' of the guide vane support 1 is configured as a substantially comb-like profile, i.e. is constituted by the comb-like slotted elements 24, at the region between the contact or bearing surfaces of the attachment bolts 27 or equivalent structure. As best seen by referring to FIGS. 9 and 10, the slots 30 of the substantially comb-like slotted elements 24 are not constructed to be wider than necessitated by the relevant bolt diameter of the attachment bolts 27, whereas the remaining wall thickness of the guide vane support 1 is substantially completely maintained at the same thickness. The outer contour of the comb-like slotted elements 24 extends approximately linearly. In order to avoid the need for providing countersunk, substantially planar nut support or contact surfaces, where at the transition to the wall there would collect relatively large amounts of material and there would have to be tolerated sharp-edge cross-sectional transitions, there are here beneficially provided, as best seen by referring to FIG. 8, below the nut members 32 of the elongation bolts 27 nut supports or underlays 28 or equivalent structure. These nut supports 28 possess a substantially cylindrical underside or bottom portion 34 which, in turn, is mounted in a correspondingly configured groove or recess 36 of the related flange or flange portion 26*a* or 26*b*, as the case may be, and which groove or recess 36 possesses a substantially semi-circular cross-sectional configuration, as best seen by referring to FIG. 7. This groove or recess 36 simultaneously forms a substantially notch-free transition from the comb-like slotted elements 24 to the inner casing defined by the wall 1' of the guide vane support 1 and secures the threaded bolts 27 together with the nut members 32 and the nut supports 28, in the threaded or tightened condition, against laterally sliding out of the related slot 30. Since the cylindrical bearing surfaces 38 of the nut supports 28 permit rotational movements about their cylinder axes, this design is at least insensitive in one plane against a canted or tilted position of the threaded bolts 27, and thus, advantageously permits coarser fabrication tolerances. Finally, it is mentioned that the connection flanges also could be integrally formed with the wall or casing of the guide vane support 1.

While there are shown and described present preferred embodiments of the invention, it is to be distinctly understood that the invention is not limited thereto, but may be otherwise variously embodied and practiced within the scope of the following claims.

Accordingly, what I claim is:

1. In a guide vane support for a gas turbine, which guide vane support possesses an at least two-part construction and is equipped with cooling channels and carries cooled guide vanes and is of substantially conical construction concentrically with respect to the lengthwise axis of the turbine, the improvement which comprises:

said two-part guide vane support comprising wall means;

cooling agent channels arranged in said wall means;

said cooling agent channels being distributed over the circumference of the wall means so as to define alternately infeed means and outfeed means for a cooling agent;

connection channel means provided for said cooling agent channels for flow communicating said cooling agent channels with individual guide vanes;

said guide vane support possessing a substantially conical configuration over its axial extent;

said wall means of said guide vane support defines a conical portion merging with a substantially cylindrical portion;

a locking element having a nose member;

hollow entry segment means secured to said locking element; and a first row of guide vanes suspendingly secured by said nose member at said substantially cylindrical portion.

2. The improvement as defined in claim 1, wherein:

said cooling agent channels are structured as inclined axially extending bores.

3. The improvement as defined in claim 2, wherein:

said cooling agent channels are arranged in a neutral zone of the wall means of said guide vane support.

4. The improvement as defined in claim 1, wherein:

said cooling agent channels comprise pipe means cast into the wall means of said guide vane support.

5. The improvement as defined in claim 1, wherein:

said guide vane support has an infeed side;

said substantially cylindrical portion being provided at said infeed side; and infeed means comprising said entry segment means arranged at said substantially cylindrical portion.

6. The improvement as defined in claim 1, further including:

substantially comb-like connection flange means provided at a parting plane between said at least two-part guide vane support.

7. The improvement as defined in claim 6, wherein:

said comb-like connection flange means comprises individual connection flange elements; and said individual connection flange elements being constituted by sheet metal members.

8. The improvement as defined in claim 6, wherein:

said comb-like connection flange means possess slots for receiving connection elements for interconnecting the two parts of the guide vane support at the region of the parting planes;

connection elements provided for said slots; and each of said slots having a width which essentially corresponds to a shaft diameter of said connection elements.

9. The improvement as defined in claim 8, wherein:

said connection elements are constituted by threaded bolts having shafts received in the slots; and said connection elements comprising elongation bolts.

10. The improvement as defined in claim 1, further including:

said segment means defining cooling agent-infeed portions cooperating with said cooling agent channels;

elastically resilent nose means provided for said guide vane support; and said infeed portions being provided with projection means cooperating with said elastically resilient nose means for securing said infeed portions in axial direction at said guide vane support.

11. The improvement as defined in claim 1, wherein:

said entry segment means contain projections; and said locking element having elastically resilient nose means with which engage said projections of said entry segment means.

* * * * *